US009076401B2

(12) United States Patent
Miyake et al.

(10) Patent No.: US 9,076,401 B2
(45) Date of Patent: Jul. 7, 2015

(54) METHOD FOR DRIVING LIQUID CRYSTAL DISPLAY DEVICE

(75) Inventors: Hiroyuki Miyake, Kanagawa (JP); Ryo Arasawa, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 269 days.

(21) Appl. No.: 13/013,231

(22) Filed: Jan. 25, 2011

(65) Prior Publication Data

US 2011/0187758 A1 Aug. 4, 2011

(30) Foreign Application Priority Data

Jan. 29, 2010 (JP) ..... 2010-019237

(51) Int. Cl.

| | |
|---|---|
| ***G09G 3/34*** | (2006.01) |
| ***G09G 3/36*** | (2006.01) |
| *G09G 5/10* | (2006.01) |

(52) U.S. Cl.

CPC ..... *G09G 3/3648* (2013.01); *G09G 3/3406* (2013.01); *G09G 2300/0443* (2013.01); *G09G 2300/0456* (2013.01); *G09G 2320/066* (2013.01); *G09G 2320/10* (2013.01); *G09G 2330/021* (2013.01); *G09G 2340/0435* (2013.01)

(58) Field of Classification Search

USPC ..... 345/690, 88

See application file for complete search history.

(56) References Cited

U.S. PATENT DOCUMENTS

| | | | | |
|---|---|---|---|---|
| 7,601,984 | B2 | 10/2009 | Sano et al. | |
| 8,158,974 | B2 | 4/2012 | Yano et al. | |
| 8,779,419 | B2 | 7/2014 | Yano et al. | |
| 2006/0132424 | A1 * | 6/2006 | Foo et al. | 345/102 |
| 2006/0284894 | A1 * | 12/2006 | Johnson et al. | 345/690 |
| 2007/0063945 | A1 * | 3/2007 | Hung et al. | 345/88 |
| 2008/0055519 | A1 * | 3/2008 | Battersby et al. | 349/68 |
| 2008/0074592 | A1 * | 3/2008 | Araki et al. | 349/114 |

(Continued)

FOREIGN PATENT DOCUMENTS

| | | |
|---|---|---|
| EP | 2453480 A | 5/2012 |
| EP | 2453481 A | 5/2012 |

(Continued)

OTHER PUBLICATIONS

International Search Report, PCT Application No. PCT/JP2010/073867, dated Feb. 8, 2011, 4 pages.

(Continued)

*Primary Examiner* — Temesgh Ghebretinsae
*Assistant Examiner* — Kwin Xie
(74) *Attorney, Agent, or Firm* — Fish & Richardson P.C.

(57) ABSTRACT

In a liquid crystal display device capable of displaying a moving image and a still image, a reduction in contrast due to light scattering in a reflective pixel portion or the like is suppressed and consumed power is reduced. As a driving method of a transflective liquid crystal display device including a plurality of pixels each including a plurality of light-transmitting pixel portions and a reflective pixel portion, an image signal for color display is supplied to the plurality of light-transmitting pixel portions and a signal for black display is supplied to the reflective pixel portion in a moving-image display period, and an image signal of black-and-white gray-scale is supplied to the plurality of light-transmitting pixel portions and the reflective pixel portion in a still-image display period.

13 Claims, 9 Drawing Sheets

(56) References Cited

U.S. PATENT DOCUMENTS

| | | | | |
|---|---|---|---|---|
| 2008/0123000 | A1* | 5/2008 | Lin et al. | 349/33 |
| 2009/0009447 | A1* | 1/2009 | Naka et al. | 345/87 |
| 2009/0179199 | A1 | 7/2009 | Sano et al. | |
| 2013/0277672 | A1 | 10/2013 | Sano et al. | |

FOREIGN PATENT DOCUMENTS

| | | | | |
|---|---|---|---|---|
| EP | 2455975 | A | | 5/2012 |
| JP | 07-159777 | A | | 6/1995 |
| JP | 2005-134645 | A | | 5/2005 |
| JP | 2006-165529 | A | | 6/2006 |
| JP | 2007-121368 | A | | 5/2007 |
| JP | 2007121368 | A | * | 5/2007 |
| JP | 2007-193242 | A | | 8/2007 |
| JP | 2007-264443 | A | | 10/2007 |
| JP | 2008-083484 | A | | 4/2008 |
| WO | WO-2006/051993 | | | 5/2006 |
| WO | WO-2008/117739 | | | 10/2008 |

OTHER PUBLICATIONS

Written Opinion, PCT Application No. PCT/JP2010/073867, dated Feb. 8, 2011, 5 pages.

Kazuhiko Tsuda et al; "Ultra low power consumption technologies for mobile TFT-LCDs"; IDW '02 : Proceedings of the 9th International Display Workshops; Dec. 4, 2002; pp. 295-298.

Ying-hui Chen et al; "Novel Low Power Consumption Color Sequential Display"; IDW '09 : Proceedings of the 9th International Display Workshops; 2009; pp. 1703-1706.

Ying-hui Chen et al; "Novel Low Power Consumption Color Sequential Display"; IDW '09 : Proceedings of the 16th International Display Workshops; 2009; pp. 1703-1706.

* cited by examiner

FIG. 3

| | 60frame～/sec. | 1frame～/min. |
|---|---|---|
| | 301 | 302 |
| DRIVER-CIRCUIT CONTROL SIGNAL | SUPPLIED | NOT SUPPLIED OTHER THAN WRITING |
| BACKLIGHT | OPERATE | NOT OPERATE |
| LIGHT-TRANSMITTING PIXEL PORTION | COLOR | BK/W |
| REFLECTIVE PIXEL PORTION | BK | BK/W |

METHOD FOR DRIVING LIQUID CRYSTAL DISPLAY DEVICE

TECHNICAL FIELD

The present invention relates to a method for driving a liquid crystal display device. Further, the present invention relates to a liquid crystal display device or an electronic device including the liquid crystal display device.

BACKGROUND ART

Liquid crystal display devices ranging from a large display device such as a television receiver to a small display device such as a mobile phone have been spreading. From now on, products with higher added values will be needed and are being developed. In recent years, in view of increase in concern about global environment and improvement in convenience of mobile equipment, development of liquid crystal display devices with low power consumption has attracted attention.

In Non-Patent Document 1, is disclosed a structure of a liquid crystal display device where refresh rates differ between the mode of moving image display and the mode of still image display for reducing power consumed by the liquid crystal display device.

In Non-Patent Document 2, is disclosed a structure of a transflective liquid crystal display device where a color image is displayed using transmitted light and a monochrome image is displayed using reflected light for reducing power consumed by the liquid crystal display device.

REFERENCE

Non-Patent Document

[Non-Patent Document 1] Kazuhiko Tsuda et al., IDW'02, pp. 295-298

[Non-Patent Document 2] Ying-hui Chen et al., IDW'09 pp. 1703-1707

DISCLOSURE OF INVENTION

As in Non-Patent Document 1, consumed power can be reduced by lowering refresh rate of when a still image is displayed. However, the structure disclosed in Non-Patent Document 1 has a problem of an insufficient reduction in power consumption because the power of the liquid crystal display is mainly consumed by lighting a backlight. Further, the structure disclosed in Non-Patent Document 2 has a problem of insufficient contrast of a displayed image particularly under high-intensity external light, due to light scattering in a reflective pixel portion or the like.

It is an object of one embodiment of the present invention is to suppress a reduction in contrast due to light scattering in a reflective pixel portion or the like to reduce consumed power.

One embodiment of the present invention is a method for driving a transflective liquid crystal display device including a plurality of pixels each including a plurality of light-transmitting pixel portions and a reflective pixel portion, which includes the steps of: in a first period, supplying a first image signal to the plurality of light-transmitting pixel portions and a signal for black display to the reflective pixel portion; and in a second period, supplying a second image signal to the plurality of light-transmitting pixel portions and the reflective pixel portion.

One embodiment of the present invention is a method for driving a transflective liquid crystal display device including: a plurality of pixels each including first to third light-transmitting pixel portions and a reflective pixel portion; and a first scan line and a second scan line which are configured to drive the liquid crystal display device, which includes the steps of: in a first period, supplying a first image signal to the first to third light-transmitting pixel portions and a signal for black display to the reflective pixel portion; and in a second period, supplying a second image signal to the first to third light-transmitting pixel portions and the reflective pixel portion. The first light-transmitting pixel portion and the reflective pixel portion are driven by the first scan line, and the second light-transmitting pixel portion and the third light-transmitting pixel portion are driven by the second scan line.

One embodiment of the present invention is a method for driving a transflective liquid crystal display device including: a plurality of pixels each including first to third light-transmitting pixel portions and a reflective pixel portion; and a first scan line and a second scan line which are configured to drive the liquid crystal display device, which includes the steps of: in a first period, supplying a first image signal to the first to third light-transmitting pixel portions and a signal for black display to the reflective pixel portion; and in a second period, supplying a second image signal to the first to third light-transmitting pixel portions and the reflective pixel portion and holding an image of the second image. The first light-transmitting pixel portion and the reflective pixel portion are driven by the first scan line, and the second light-transmitting pixel portion and the third light-transmitting pixel portion are driven by the second scan line.

In the method for driving a liquid crystal display device which is one embodiment of the present invention, the first scan line and the second scan line may drive in this order.

In the method for driving a liquid crystal display device which is one embodiment of the present invention, an operation frequency of a driver circuit which drives the first scan line and the second scan line in the second period may be lower than an operation frequency of the driver circuit which drives the first scan line and the second scan line in the first period.

In the method for driving a liquid crystal display device which is one embodiment of the present invention, the first to third light-transmitting pixel portions may be light-transmitting pixel portions emitting respective colors of red, green, and blue, and the first image signal supplied in the first period may be an image signal corresponding to any of colors of red, green, and blue.

In the method for driving a liquid crystal display device which is one embodiment of the present invention, the second image signal may be a grayscale image signal.

In the method for driving a liquid crystal display device which is one embodiment of the present invention, the holding an image of the second image signal in the second period may be performed by stopping supply of a driver-circuit control signal for driving the first scan line and the second scan line.

According to one embodiment of the present invention, a reduction in contrast due to light scattering in the reflective pixel portion or the like can be suppressed without increasing the number of driver circuits, wirings, and the like, so that consumed power can be reduced.

BRIEF DESCRIPTION OF DRAWINGS

FIG. 3 is a diagram for describing operation of a liquid crystal display device according to one embodiment of the present invention.

BEST MODE FOR CARRYING OUT THE INVENTION

Figure 1:
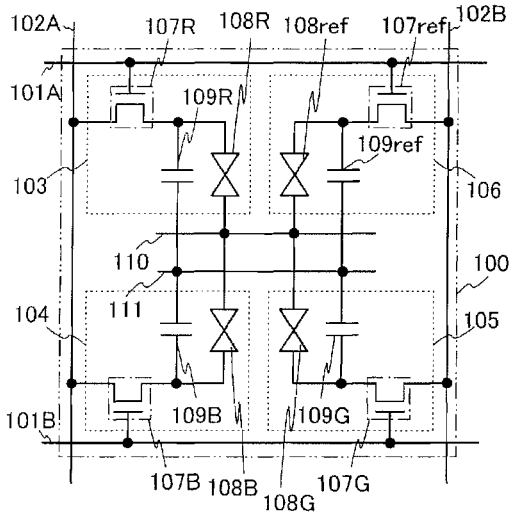
FIG. 1 is a diagram for describing a pixel according to one embodiment of the present invention.

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Accordingly, the present invention is not construed as being limited to the described content of the embodiments and included herein. Note that identical portions or portions having the same function in all drawings illustrating the structure of the invention that are described below are denoted by the same reference numerals.

Note that the size, the thickness of a layer, distortion of the waveform of a signal, and a region of each structure illustrated in the drawings and the like in the embodiments are exaggerated for simplicity in some cases. Therefore, embodiments of the present invention are not limited to such scales.

Note that in this specification, terms such as "first", "second", "third", and "N-th" (N is a natural number) are used in order to avoid confusion among components and do not limit the number of the components.

Embodiment 1

In this embodiment, a method for driving a liquid crystal display device will be described with reference to a circuit diagram of a pixel in the liquid crystal display device, a timing chart for describing operation thereof, and the like.

FIG. 1 is a circuit diagram of a pixel, and a structure thereof is described first. FIG. 1 illustrates a pixel 100, a first scan line 101A (also referred to as a gate line), a second scan line 101B, a first signal line 102A (also referred to as a data line), and a second signal line 102B. The pixel 100 includes a first light-transmitting pixel portion 103, a second light-transmitting portion 104, a third light-transmitting pixel portion 105, and a reflective pixel portion 106. The first light-transmitting pixel portion 103 includes a pixel transistor 107R, a liquid crystal element 108R, and a capacitor 109R. The second light-transmitting pixel portion 104 includes a pixel transistor 107B, a liquid crystal element 108B, and a capacitor 109B. The third light-transmitting pixel portion 105 includes a pixel transistor 1070, a liquid crystal element 108G, and a capacitor 109G. The reflective pixel portion 106 includes a pixel transistor 107ref, a liquid crystal element 108ref, and a capacitor 109ref.

In the first light-transmitting pixel portion 103, a first terminal of the pixel transistor 107R is connected to the first signal line 102A, and a gate of the pixel transistor 107R is connected to the first scan line 101A. A first electrode (pixel electrode) of the liquid crystal element 108R is connected to a second terminal of the pixel transistor 107R, and a second electrode (counter electrode) of the liquid crystal element 108R is connected to a common potential line 110 (common line). A first electrode of the capacitor 109R is connected to the second terminal of the pixel transistor 107R, and a second electrode of the capacitor 109R is connected to a capacitor line 111.

In the second light-transmitting pixel portion 104, a first terminal of the pixel transistor 107B is connected to the first signal line 102A, and a gate of the pixel transistor 107B is connected to the second scan line 101B. A first electrode (pixel electrode) of the liquid crystal element 108B is connected to a second terminal of the pixel transistor 107B, and a second electrode (counter electrode) of the liquid crystal element 108B is connected to the common potential line 110 (common line). A first electrode of the capacitor 109B is connected to the second terminal of the pixel transistor 107B, and a second electrode of the capacitor 109B is connected to the capacitor line 111.

In the third light-transmitting pixel portion 105, a first terminal of the pixel transistor 107G is connected to the second signal line 102B, and a gate of the pixel transistor 107G is connected to the second scan line 101B. A first electrode (pixel electrode) of the liquid crystal element 108G is connected to a second terminal of the pixel transistor 1070, and a second electrode (counter electrode) of the liquid crystal element 108G is connected to the common potential line 110 (common line). A first electrode of the capacitor 109G is connected to the second terminal of the pixel transistor 107G, and a second electrode of the capacitor 109G is connected to the capacitor line 111.

In the reflective pixel portion 106, a first terminal of the pixel transistor 107ref is connected to the second signal line 102B, and a gate of the pixel transistor 107ref is connected to the first scan line 101A. A first electrode (pixel electrode) of the liquid crystal element 108ref is connected to a second terminal of the pixel transistor 107ref, and a second electrode (counter electrode) of the liquid crystal element 108ref is connected to the common potential line 110. A first electrode of the capacitor 109ref is connected to the second terminal of the pixel transistor 107ref, and a second electrode of the capacitor 109ref is connected to the capacitor line 111.

Note that the pixel transistor 1078, the pixel transistor 1070, the pixel transistor 107B, and the pixel transistor 107ref preferably each include an oxide semiconductor in a semiconductor layer. The oxide semiconductor here is an intrinsic (i-type) oxide semiconductor which is highly purified by removal of hydrogen that is an n-type impurity so that impurities other than main components of the oxide semiconductor are contained as little as possible. In addition, the highly purified oxide semiconductor includes extremely few carriers (close to zero), and the carrier concentration thereof is lower than $1\times10^{14}/cm^3$, preferably lower than $1\times10^{12}/cm^3$, much preferably $1\times10^{11}/cm^3$. A considerable reduction in carriers in the oxide semiconductor enables the off current of the transistor to decrease. Specifically, a transistor including the above oxide semiconductor layer can realize the off current which is less than or equal to 10 aA/μm ($1\times10^{-17}$ A/μm), preferably less than or equal to 1 aA/μm ($1\times10^{-18}$ A/μm), much preferably less than or equal to 10 zA/μm ($1\times10^{-20}$ A/μm), per micrometer in channel width at room temperature. In other words, in circuit design, the oxide semiconductor layer can be regarded as an insulator when the transistor is off. In the pixel 100 including pixel portions provided with transistors each of which includes an oxide semiconductor and has significantly low off current, an image can be maintained even when the writing frequencies of an image signal (also referred to as a video voltage, a video signal, or a video data) are low, and thus the refresh rate can be reduced. Therefore, a period during which a driver circuit is stopped driving the first scan line, the second scan line, and the signal line can be provided; accordingly, consumed power can be reduced.

Note that a transistor is an element having at least three terminals of gate, drain, and source. The transistor includes a channel region between a drain region and a source region, and current can flow through the drain region, the channel region, and the source region. Here, since the source and the drain of the transistor may change depending on the structure, the operating condition, and the like of the transistor, it is difficult to define which is a source or a drain. Therefore, in this document (the specification, the claims, the drawings, and the like), a region functioning as a source and a drain is not called the source or the drain in some cases. In such a case, for example, one of the source and the drain may be referred to as a first terminal and the other thereof may be referred to as a second terminal. Alternatively, one of the source and the drain may be referred to as a first electrode and the other thereof may be referred to as a second electrode. Further alternatively, one of the source and the drain may be referred to as a source region and the other thereof may be called a drain region.

Note that when it is explicitly described that "A and B are connected", the case where A and B are electrically connected, the case where A and B are functionally connected, and the case where A and B are directly connected are included therein.

Note that a pixel corresponds to a display unit where the first to third light-transmitting pixel portions and the reflective pixel portion which are elements capable of controlling brightness are combined. For example, the first to third light-transmitting pixel portions (also referred to as subpixels) function as display units capable of controlling brightness of color elements R (red), G (green), and B (blue) which are combined for displaying color images when moving images are displayed. The reflective pixel portion functions as a display unit capable of controlling brightness of grayscale (or monochrome) images when a still image is displayed.

Since in this embodiment, an example in which color display is performed using three color elements of RGB in the light-transmitting pixel portions is given, the specific structures of the first to third light-transmitting pixel portions are described. However, the structure described in this embodiment does not particularly limit the number of light-transmitting pixel portions, and a plurality of light-transmitting pixel portions can be employed instead of the first to third light-transmitting pixel portions. For example, four element colors where Y (yellow) is added to RGB may be used for a plurality of light-transmitting pixel portions, and alternatively, combination of colors other than RGB may be used. Further, a signal line and a scan line connected to the pixel may be provided as appropriate in accordance with a plurality of light-transmitting pixel portions and connected to the plurality of light-transmitting pixel portions.

Note that "voltage" refers to a potential difference between a given potential and a reference potential (e.g., a ground potential) in many cases. Accordingly, voltage, potential, and a potential difference can be referred to as potential, voltage, and a voltage difference, respectively.

The common potential supplied to the common potential line 110 may be any potential as long as it serves as a reference with respect to a potential of an image signal supplied to the first electrode of the liquid crystal element. For example, the common potential may be a ground potential.

The image signal may be appropriately inverted in accordance with dot inversion driving, source line inversion driving, gate line inversion driving, frame inversion driving, or the like to be input to each pixel.

The potential of the capacitor line 111 may be the same as the common potential. Further, the capacitor line 111 may be supplied with another signal.

Of each of the liquid crystal elements 108R, 108G, 108B, and 108ref, the second electrode is preferably provided to overlap with the first electrode thereof. The first electrode and the second electrode of each liquid crystal element may have a variety of opening patterns. A liquid crystal material sandwiched between the first electrode and the second electrode in each liquid crystal element may be any of a thermotropic liquid crystal, a low-molecular liquid crystal, a high-molecular liquid crystal, a polymer dispersed liquid crystal (PDLC), a ferroelectric liquid crystal, or an anti-ferroelectric liquid crystal. These liquid crystal materials exhibit a cholesteric phase, a smectic phase, a cubic phase, a chiral nematic phase, an isotropic phase, or the like depending on conditions. Alternatively, a liquid crystal exhibiting a blue phase for which an alignment film is unnecessary may be used.

The first electrode of each of the liquid crystal elements 108R, 1086, and 108B is formed using a light-transmitting material. As examples of the light-transmitting material, indium tin oxide (ITO), zinc oxide (ZnO), indium zinc oxide (IZO), gallium-doped zinc oxide (GZO), and the like can be given. On the other hand, the first electrode of the liquid crystal element 108ref is a metal electrode with high reflectivity. Specifically, aluminum, silver, or the like is used. When the surface of the pixel electrode of the liquid crystal element 108ref has unevenness, incident external light can be reflected diffusely. Note that the first electrode, the second electrode, and the liquid crystal material may be collectively referred to as a liquid crystal element.

Figure 2:
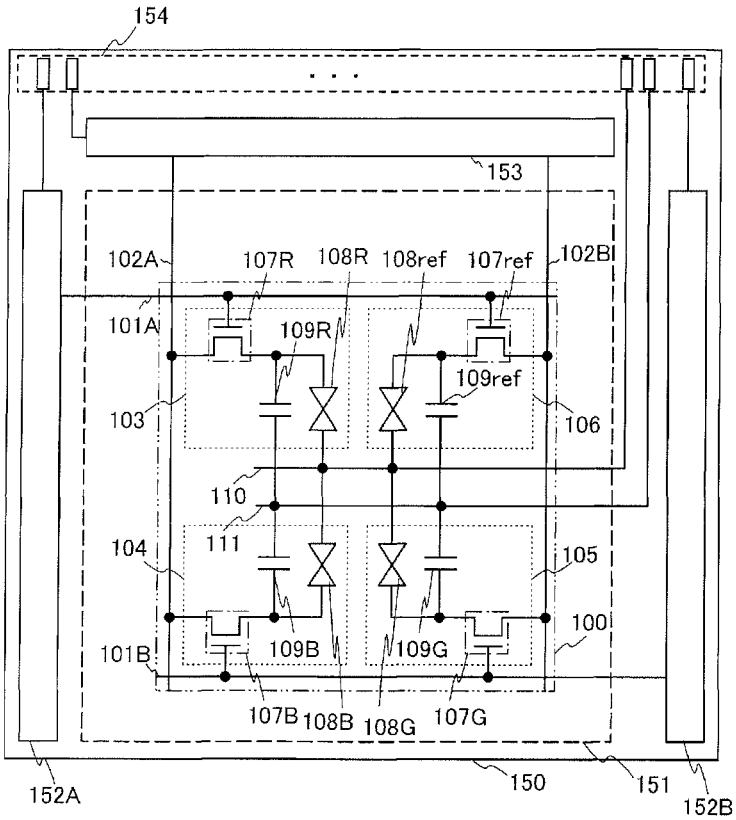
FIG. 2 is a diagram for describing a liquid crystal display device according to one embodiment of the present invention.

FIG. 2 is a schematic view of a liquid crystal display device including the pixel 100 described in FIG. 1. FIG. 2 illustrates, over a substrate 150, a pixel region 151, a first scan line driver circuit 152A (also referred to as a gate line driver circuit), a second scan line driver circuit 152B, a signal line driver circuit 153 (also referred to as a data line driver circuit), and a terminal portion 154.

In FIG. 2, the first scan line 101A is driven by the first scan line driver circuit 152A so as to control on/off of the pixel transistor 107R and the pixel transistor 107ref. The second scan line 101B is supplied with a signal from the second scan line driver circuit 152B so as to control on/off of the pixel transistor 107B and the pixel transistor 107G. The first signal line 102A is, from the signal line driver circuit 153, supplied with an image signal which is supplied to the liquid crystal element 108R and the liquid crystal element 108B. The second signal line 102B is also, from the signal line driver circuit 153, supplied with an image signal which is supplied to the liquid crystal element 108ref and the liquid crystal element 108G. Further, the common potential line 110 and the capacitor line 111 are supplied with signals with given potential from the terminal portion 154.

Although it is preferable that the first scan line driver circuit 152A, the second scan line driver circuit 152B, and the signal line driver circuit 153 are provided over the same substrate as the pixel region 151, it is not necessarily to provide them over the same substrate. When the first scan line driver circuit 152A, the second scan line driver circuit 152B, and the signal line driver circuit 153 are provided over the same substrate as the pixel region 151, the number of terminals for external connection to can be reduced; thus downsizing the liquid crystal display device can be achieved.

In the pixel region 151, the pixels 100 are provided (arranged) in matrix. Here, description that "the pixels are provided (arranged) in matrix" includes the case where the pixels are arranged in a straight line and the case where the pixels are arranged in a jagged line, in a longitudinal direction or a lateral direction.

Signals supplied from the terminal portion 154 include a signal for controlling the first scan line driver circuit 152A, the second scan line driver circuit 1528, and the signal line driver circuit 153 (high power supply potential $V_{dd}$, low power supply potential $V_{ss}$, a start pulse SP, and a clock signal CK: hereinafter, referred to as a driver-circuit control signal) and the like in addition to the signal supplied to the common potential line 110 and the capacitor line 111. The first scan line driver circuit 152A, the second scan line driver circuit 152B, and the signal line driver circuit 153 to each of which a driver-circuit control signal is supplied may include a shift register in which flip-flop circuits or the like are cascaded. Image signals for color display are supplied through the first signal line 102A to the liquid crystal element 108R in the first light-transmitting pixel portion 103 and the liquid crystal element 108B in the second light-transmitting pixel portion 104 and through the second signal line 102B to the liquid crystal element 108G in the third light-transmitting pixel portion 105. An image signal for black grayscale display is supplied through the second signal line 102B to the liquid crystal element 108ref in the reflective pixel portion 106.

Next, operation of the liquid crystal display device is described with reference to FIG. 3, FIG. 4, FIG. 5, and FIGS. 6A and 6B as well as FIG. 2.

As shown in FIG. 3, the operation of the liquid crystal display device is roughly classified into a moving-image display period 301 (also referred to as a first period) and a still-image display period 302 (also referred to as a second period). The moving-image display period 301 and the still-image display period 302 may be switched by supplying a switching signal from the outside or by judging the moving-image display period 301 or the still-image display period 302 based on an image signal.

The cycle of one frame period (or frame frequency) is preferably less than or equal to 1/60 sec (more than or equal to 60 Hz) in the moving-image display period 301. The high frame frequency can prevent a viewer from perceiving flickering. In the still-image display period 302, the cycle of one frame period is extremely long, for example, longer than or equal to one minute (less than or equal to 0.017 Hz), so that eye strain can be alleviated as compared to the case where the same image is switched plural times.

When the pixel transistors 107R, 107G, 107B, and 107ref each include an oxide semiconductor as a semiconductor layer, carriers in the oxide semiconductor can be drastically reduced as described above, which results in a decrease in off current. Thus, in the pixel, an electrical signal such as an image signal can be held for a longer time, and a writing interval can be set longer. As a result, the cycle of one frame can be set long, and a reduction in the number of operations of writing an image signal the same as that written in the previous frame period, i.e., a reduction in refresh rates can be achieved in the still-image display period 302. Therefore, the effect of reducing consumed power can be improved.

The moving-image display period 301 shown in FIG. 3 has such a structure that color display is performed by controlling the amount of light from the backlight by the liquid crystal elements in the first to third light-transmitting pixel portions 103 to 105 provided with color filters. In the moving-image display period 301 shown in FIG. 3, since moving images are displayed by active matrix driving, driver-circuit control signals are supplied to the first scan line driver circuit 152A, the second scan line driver circuit 152B, and the signal line driver circuit 153. Further, in the moving-image display period 301 shown in FIG. 3, the backlight operates to transmit light through the first to third light-transmitting pixel portions 103 to 105 provided with the color filters. Then, a color moving image can be displayed on a display panel.

In the moving-image display period 301, an image signal is supplied to the first signal line 102A and the second signal line 102B from the signal line driver circuit 153 in order to perform color display (in FIG. 3, denoted by COLOR) on the first to third light-transmitting pixel portions 103 to 105. The image signal supplied to the first to third light-transmitting pixel portions 103 to 105 in the moving-image display period 301 is an image signal for color display, which is also referred to as a first image signal. Furthermore, in the moving-image display period 301, an image signal for black grayscale display (in FIG. 3, denoted by BK) on the reflective pixel portion 106 is supplied from the second signal line 102B. By supplying the image signal for black grayscale to the reflective pixel portion 106, scattering of incident external light can be reduced in the reflective pixel portion 106; thus, contrast of the first to third light-transmitting pixel portions 103 to 105 can be improved.

In the still-image display period 302 shown in FIG. 3, an image signal is supplied from the first signal line 102A and the second signal line 102B so that a black-and-white grayscale (in FIG. 3, denoted by BK/W) can be provided by transmitting or non-transmitting reflected light in the reflective pixel portion 106, whereby a still image can be displayed. In the still-image display period 302, the driver-circuit control signal is supplied only when the image signal of black-and-white grayscale is written. While the image signal which has been written is being held in the still-image display period 302, the supply of the driver-circuit control signal is partly or completely stopped. Therefore, consumed power corresponding to the stop of supplying the driver-circuit control signal can be reduced in the still-image display period 302. In the still-image display period 302 in FIG. 3, display comes to be visible utilizing reflected external light; thus, the backlight need not operate. Then, the display panel holds the still image display of black-and-white grayscale for a certain period. The still image display of black-and-white grayscale can be held without deterioration of the image, by regularly performing refresh operation in which an image signal the same as that written in the previous frame period is rewritten.

Note that the image signal of black-and-white grayscale indicates an image signal for displaying a grayscale or monochrome image on the reflective pixel portion. Therefore, in the case where the image signal of black-and-white grayscale is written to the pixel portions provided with color filters, the pixel portions function as monochrome pixel portions, and colors of the monochrome pixel portions are mixed, so that the grayscale or monochrome images are displayed. The image signal of black-and-white grayscale supplied to the reflective pixel portion 106 in the still-image display period 302 is referred to as a second image signal.

As for the stop of the supply of the driver-circuit control signals in the still-image display period 302, in the case where the holding period of the image signal which has been written is short, a configuration in which supply of the high power supply potential $V_{dd}$ and the low power supply potential $V_{ss}$ is not stopped may be originally employed. Thus, an increase in power consumption due to repetition of stop and start of supply of the high power supply potential $V_{dd}$ and the low power supply potential $V_{ss}$ can be reduced, which is favorable.

In the case where a plurality of pixel portions are employed for the first to third light-transmitting pixel portions, the first image signal and the image signal for displaying black grayscale may be supplied to the plurality of light-transmitting pixel portions and the reflective pixel portion, respectively in the moving-image display period 301, and the second image signal may be supplied to both the plurality of light-transmitting pixel portions and the reflective pixel portion in the still-image display period 302.

Next, the moving-image display period 301 and the still-image display period 302 of FIG. 3 will be described in detail with reference to timing charts of FIG. 4 and FIG. 5, respectively. The timing charts of FIG. 4 and FIG. 5 are exaggerated for description.

Figure 4:
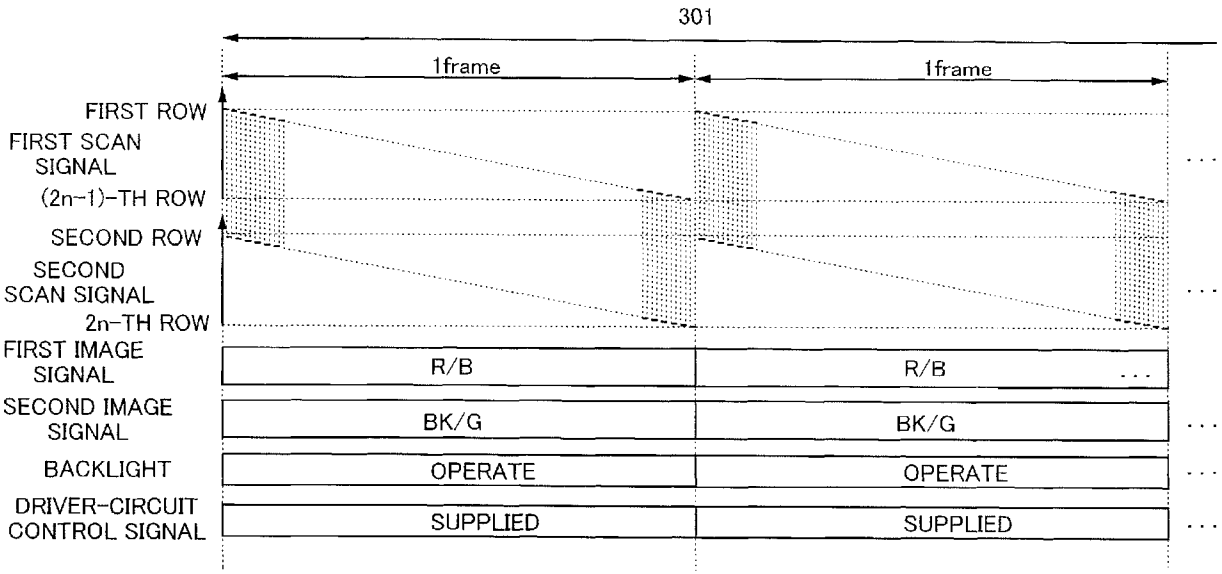
FIG. 4 is a diagram for describing operation of a liquid crystal display device according to one embodiment of the present invention.

First, FIG. 4 is described. FIG. 4 shows the supply of signals in the series of frame periods included in the moving-image display period 301, as an example. Note that in FIG. 4, since a period for displaying moving images is described, an image signal in one frame period is different from that in the sequential frame period in many cases. Thus, image signals are written successively every short frame period. FIG. 4 shows the lighting state of the backlight and the state of supplying the following signals: a signal of the first scan line 101A (a first scan line signal), a signal of the second scan line 101B (a second scan signal), an image signal supplied to the first signal line 102A, an image signal supplied to the second signal line 102B, and a driver-circuit control signal.

Figure 5:
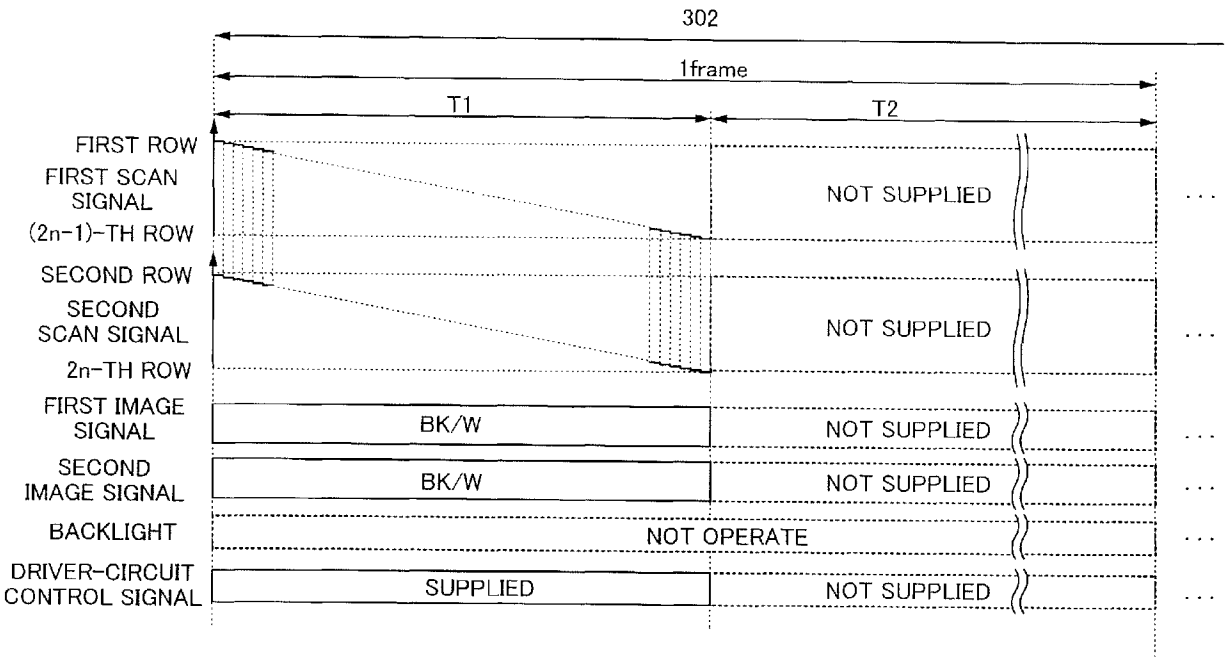
FIG. 5 is a diagram for describing operation of a liquid crystal display device according to one embodiment of the present invention.

The first scan signal shown in FIG. 4 and FIG. 5 indicates a scan signal supplied to a scan line in odd-numbered rows (referred to as in (2n−1)-th rows, where n is a natural number). In other words, the first scan signal is a signal for controlling on/off of the pixel transistor 107R in the first light-transmitting pixel portion 103 and the pixel transistor 107ref in the reflective pixel portion 106. Further, the second scan signal shown in FIG. 4 and FIG. 5 indicates a scan signal supplied to a scan line in even-numbered rows (referred to as in 2n-th rows, where n is a natural number). In other words, the second scan signal is a signal for controlling on/off of the pixel transistor 107B in the second light-transmitting pixel portion 104 and the pixel transistor 107G in the third light-transmitting pixel portion 105.

In the moving-image display period 301, the scan lines are sequentially selected by inputting the first scan signal and the second scan signal alternately. Specifically, the scan line in a first row is selected by input of the first scan signal, and the scan line in a second row is selected by input of the second scan signal, i.e., the scan line in a (2n−1)-th row is selected by input of the first scan signal, and then, the scan line in a 2n-th row is selected by input of the second scan signal. As shown in FIG. 4, during one frame period in the moving-image display period 301, the scan lines are sequentially selected so that the first scan signal and the second scan signal are alternately input in this order. Thus, the first scan line driver circuit 152A and the second scan line driver circuit 152B are supplied with the driver-circuit control signal such as a clock signal so as to alternately output the first scan signal and the second scan signal controlling on/off of the pixel transistors.

Further, image signals corresponding to pixels are supplied from the first signal line 102A and the second signal line 102B to the pixels in accordance with the first scan signal and the second scan signal which are the signals controlling on/off of the pixel transistors and supplied to the scan lines. Specifically, as shown in FIG. 4, the image signal supplied to the first signal line 102A is an image signal for displaying R (red) supplied to the first light-transmitting pixel portion 103 and an image signal for displaying B (blue) supplied to the second light-transmitting pixel portion 104 (in FIG. 4, referred to as R/B). In addition, as shown in FIG. 4, the image signal supplied to the second signal line 102E is an image signal of black grayscale (BK) (an image signal for displaying black) supplied to the reflective pixel portion 106 and an image signal for displaying G (green) supplied to the third light-transmitting pixel portion 105 (in FIG. 4, MUG).

In addition, in the moving-image display period 301, the backlight for transmitting light through the first to third light-transmitting pixel portions 103 to 105 each provided with the color filter operates. Further, in the moving-image display period 301, the first scan line driver circuit 152A, the second scan line driver circuit 152B, and the signal line driver circuit 153 are supplied with the driver-circuit control signals for outputting the following signals at the given timing: the first scan signal, the second scan signal, the image signal supplied to the first signal line 102A, and the image signal supplied to the second signal line 102B.

Figure 6A:
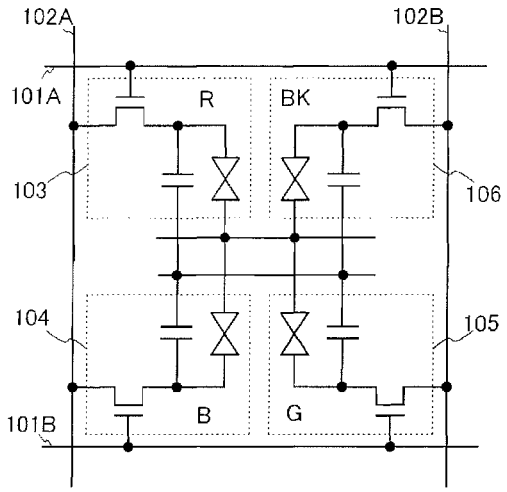
FIGS. 6A and 6B are diagrams for describing operation of a pixel according to one embodiment of the present invention.

In other words, the moving-image display period 301 is a period for selecting the first light-transmitting pixel portion and the reflective pixel portion by inputting the first scan signal, selecting the second light-transmitting pixel portion and the third light-transmitting pixel portion by inputting the second scan signal, supplying the first image signal for performing color display on the first to third light-transmitting pixel portions, and supplying the image signal for displaying black on the reflective pixel portion. Specifically, the image signals written to the pixel portions in the moving-image display period 301 are shown in FIG. 6A. In FIG. 6A, visualized is the state in which the image signal for R display on the first light-transmitting pixel portion 103 and the image signal for black (BK) grayscale display on the reflective pixel portion 106 are written after inputting the first scan signal and the image signal for B display on the second light-transmitting pixel portion 104 and the image signal for G display on the third light-transmitting pixel portion 105 are written after inputting the second scan signal.

By repeating the above operation, the image signal for R (red) display supplied to the first light-transmitting pixel portion 103, the image signal for B (blue) display supplied to the second light-transmitting pixel portion 104, and the image signal for G (green) display supplied to the third light-transmitting pixel portion 105 are changed while the image signal of the black grayscale is supplied to the reflective pixel portion 106. As a result, a viewer can perceive color display of a moving image. In addition, the image signal for black grayscale display on the reflective pixel portion 106 is supplied in the moving-image display period 301 as shown in FIG. 6A, whereby light scattering due to incident external light can be reduced in the reflective pixel portion 106. Thus, contrast of the first to third light-transmitting pixel portions 103 to 105 can be improved.

Note that although a structure in which the first image signal is supplied on the condition that the first light-transmitting pixel portion 103, the second light-transmitting pixel portion 104, and the third light-transmitting pixel portion 105 correspond to RGB respectively is described with FIG. 4, another color may be combined instead of any of RGB. Alternatively, another light-transmitting pixel portion may be additionally provided and an image signal corresponding thereto may be supplied, so that display is performed using more colors.

Next, FIG. 5 is described. FIG. 5 shows, in the still-image display period 302, a lighting state of the backlight and a state of supplying the following signals: the first scan signal, the second scan signal, the image signal supplied to the first signal line 102A, the image signal supplied to the second signal line 102B, and the driver-circuit control signal, similarly to FIG. 4. Note that in FIG. 5, the still-image display period 302 is divided into a still-image signal writing period (in FIG. 5, referred to as T1) and a still-image signal holding period (in FIG. 5, referred to as T2).

During the still-image signal writing period in the still-image display period 302, the scan lines are selected by the first scan signal and the second scan signal in order to write an image signal for displaying a black-and-white grayscale image depending on whether reflected light is transmitted or not. The scan lines are sequentially selected in such a manner that the scan line in the first row is selected by the first and second scan signals, and the scan line in the second row is selected by the first and second scan signals. The scan line in a (2n−1)-th row and the scan line in a 2n-th row can be selected at the same timing. That is, the first scan line 101A and the second scan line 101B connected to one pixel are selected at the same timing as shown in FIG. 5. Thus, the driver-circuit control signal may control the first scan signal and the second signal at the same timing, and accordingly the operating frequency of a clock signal for controlling the first and second scan line driver circuits 152A and 152B can be reduced to half of that of a clock signal in the moving-image display period 301. As a result, power consumed during the still-image signal writing period in the still-image display period 302 can be reduced.

Note that during the still-image signal writing period of the still-image display period 302, the backlight does not operate.

Figure 6B:
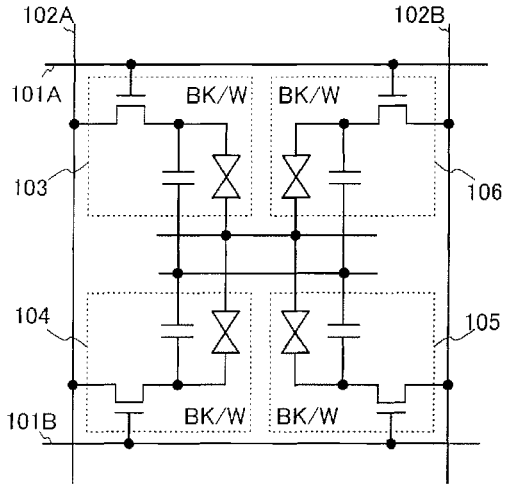

During the still-image signal writing period in the still-image display period 302, image signals corresponding to the pixels which display a black-and-white grayscale image depending on whether reflected light is transmitted or not are supplied from the first signal line 102A and the second signal line 102B to the pixels in accordance with the first scan signal and the second scan signal which are the signals controlling on/off of the pixel transistors and supplied to the scan lines. Specifically, as shown in FIG. 5, the image signal supplied to the first signal line 102A is an image signal of black-and-white grayscale supplied to the first light-transmitting pixel portion 103 and an image signal of black-and-white grayscale supplied to the second light-transmitting pixel portion 104 (in FIG. 5, referred to as BK/W). In addition, as shown in FIG. 5, the image signal supplied to the second signal line 102B is an image signal of black-and-white grayscale supplied to the reflective pixel portion 106 and an image signal of black-and-white grayscale supplied to the third light-transmitting pixel portion 105 (in FIG. 5, referred to as BK/W). The image signals written to the pixel portions during the still-image signal writing period in the still-image display period 302 are shown in FIG. 6B. In FIG. 6B, visualized is the state in which the image signals of black-and-white grayscale are written to the first light-transmitting pixel portion 103 and the reflective pixel portion 106 after inputting the first scan signal and the image signals of black-and-white grayscale are written to the second light-transmitting pixel portion 104 and the third light-transmitting pixel portion 105 after inputting the second scan signal.

Note that during the still-image signal writing period in the still-image display period 302, the driver-circuit control signals are supplied to the first scan line driver circuit 152A, the second scan line driver circuit 152B, and the signal line driver circuit 153 so as to output the first scan signal, the second scan signal, and the image signal, respectively, at the given timing.

As described, during the still-image signal writing period in the still-image display period 302, the image signal of black-and-white grayscale is supplied to the first to third light-transmitting pixel portions 103 to 105 in addition to the reflective pixel portion 106. Although the backlight does not operate during the still-image signal writing period in the still-image display period 302 in FIG. 5, an image might be dark and difficult to see owing to insufficient reflection of light in the reflective pixel portion 106, depending on the environment or the like. In such a case, the visibility can be secured by operating the backlight and switching display to the display of the first to third light-transmitting pixel portions 103 to 105 into which the black-and-white grayscale signal has been written. The switching of an operating state and a non-operating state of the backlight may be performed only when the visibility is insufficient; therefore, an optical sensor or the like may be additionally provided and the switching may be performed in accordance with the illuminance of the environment. Note that the operating state and the non-operating state of the backlight may be switched by manual operation with a switch or the like. Further, by using an oxide semiconductor for the pixel transistor 107R, the pixel transistor 107G, the pixel transistor 107B, and the pixel transistor 107ref, the off current thereof can be reduced. Reduction in off current leads to a long still-image signal holding period; therefore, the use of an oxide semiconductor is preferable for reduction in power consumption.

Next, during the still-image signal holding period in the still-image display period 302, the image signal for displaying a black-and-white grayscale image which has been written is held, so that a still image is displayed. At this time, additional image signals supplied to the first signal line 102A and the second signal line 102B by the first scan signal and the second scan signal are not written, the backlight does not operate, and the driver-circuit control signal is not supplied. Therefore, power consumed by the backlight and the driver-circuit control signal can be reduced; thus, lower power consumption can be achieved. As for the holding of the still image, the image signal written into a pixel is held by a pixel transistor whose off current is extremely small; therefore, the black-and-white grayscale still image can be held for longer than or equal to one minute. In addition, the still image may be held in the following manner: before the level of the image signal held is lowered after a certain period of time, a new still image signal which is the same image signal as the still image signal of the previous period is written and the still image is held again.

During the still-image signal holding period, the frequency of operation such as writing of an image signal can be reduced. When seeing an image formed by writing image signals a plurality of times, the human eyes recognize images switched a plurality of times, which might lead to eyestrain. With a structure where the frequency of writing of image signals is reduced as described in this embodiment, eyestrain can be alleviated.

In the above-described manner, according to an embodiment of the present invention, reduction in contrast due to light scattering in a reflective pixel portion or the like can be suppressed and power consumption can be reduced without making the structure complicated, for example, increase in the number of driver circuits, wirings, and the like.

This embodiment can be implemented in combination with any of the structures described in the other embodiments as appropriate.

Embodiment 2

In this embodiment, a structure corresponding to the pixel of the liquid crystal display device which is described in Embodiment 1 with FIG. 1 will be described with reference to a top view and a cross-sectional view.

Figure 7A:
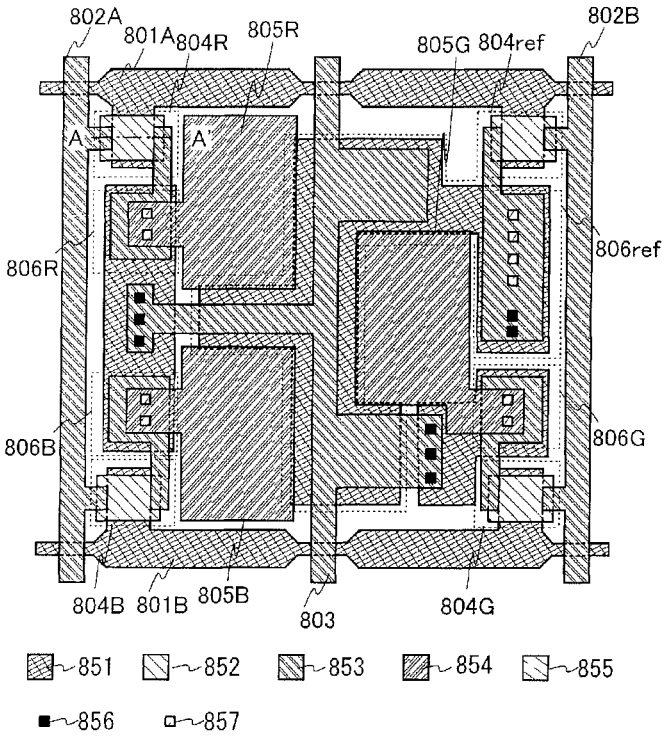
FIGS. 7A and 7B are a top view and a cross-sectional view illustrating a pixel according to one embodiment of the present invention.
Figure 7B:
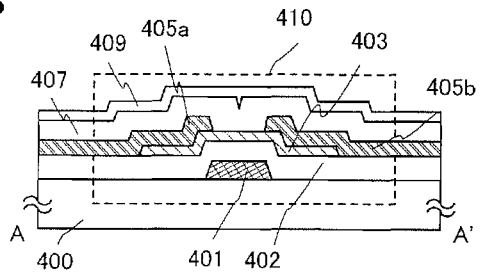
Figure 8:
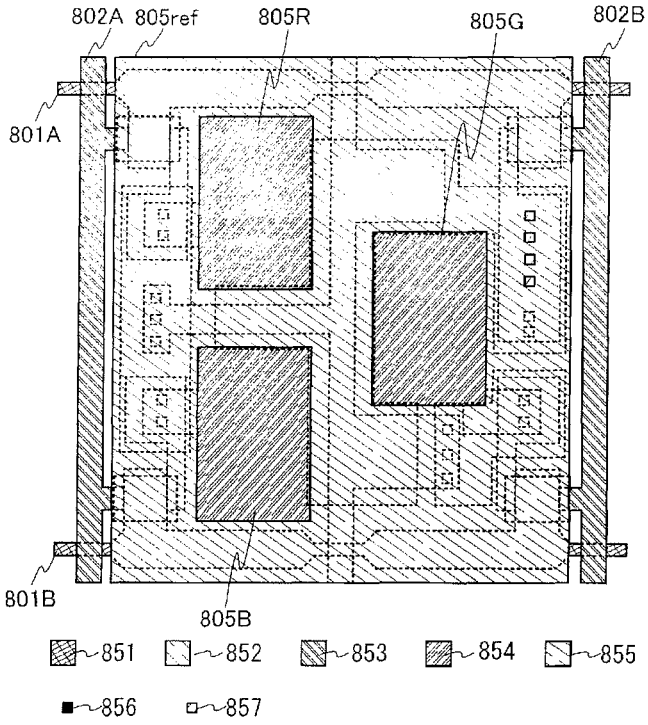
FIG. 8 is a top view illustrating a pixel according to one embodiment of the present invention.

FIGS. 7A and 7B are respectively a top view and a cross-sectional view in the case where the pixel transistors 107R, 107G, 107B, and 107ref which are described in Embodiment 1 are inverted staggered transistors. The cross-sectional view of the pixel illustrated in FIG. 7B corresponds to line A-A' in the top view of the pixel illustrated in FIG. 7A. FIG. 8 is a layout of the pixel corresponding to FIG. 7A, in which a reflective conductive layer is illustrated.

First, an example of the layout of the pixel in the liquid crystal display device is described with reference to FIG. 7A and FIG. 8. Note that FIGS. 7A and 7B and FIG. 8 illustrate a structure used for the pixel 100 described in Embodiment 1.

The pixel illustrated in FIG. 7A and FIG. 8 can be applied to the liquid crystal display device in Embodiment 1 and as components corresponding to those in FIG. 1, includes a first scan line 801A, a second scan line 801B, a first signal line 802A, a second signal line 802B, a capacitor line 803, a pixel transistor 804R, a pixel electrode 805R, a capacitor 806R, a pixel transistor 804B, a pixel electrode 805B, a capacitor 806B, a pixel transistor 804G, a pixel electrode 8056, a capacitor 806G a pixel transistor 804ref, a pixel electrode 805ref (illustrated in only FIG. 8), and a capacitor 806ref. The above components include a conductive layer 851, a semiconductor layer 852, a conductive layer 853, a transparent conductive layer 854, a reflective conductive layer 855, a contact hole 856, and a contact hole 857.

The conductive layer 851 has regions functioning as a gate electrode and a scan line. The semiconductor layer 852 has regions functioning as a semiconductor layer of the pixel transistors. The conductive layer 853 has regions functioning as wirings and source and drain of the pixel transistors. The transparent conductive layer 854 has regions functioning as pixel electrodes of the liquid crystal elements in the light-transmitting pixel portions. The reflective conductive layer 855 (illustrated in only FIG. 8) has a region functioning as a pixel electrode of the liquid crystal element in the reflective pixel portion. The contact holes 856 function to connect the conductive layer 851 and the conductive layer 853. The contact holes 857 function to connect the conductive layer 853 and either transparent conductive layer 854 or the reflective conductive layer 855.

As shown in FIG. 8, in the layout of the pixel in which the reflective conductive layer 855 functioning as the pixel electrode 805ref is illustrated, the reflective conductive layer 855 functioning as the pixel electrode 805ref is provided to overlap with the pixel transistors and the capacitors. Further, the reflective conductive layer 855 has openings in portions where the transparent conductive layer 854 functions as the pixel electrode 805R, the pixel electrode 805G, and the pixel electrode 805B, whereby the pixel electrodes of the light-transmitting pixel portions and the pixel electrode in the reflective pixel portion are arranged in an efficient manner.

Note that the reflective conductive layer 855 preferably has an unevenness surface in order to reflect the incident external light diffusely.

In the layouts of the pixel in FIG. 7A and FIG. 8, the pixel electrode 805R, the pixel electrode 805G, and the pixel electrode 805B are provided to be apart from the first signal line 802A and the second signal line 802B. The pixel electrodes 805R, 805G, and 805B are provided to be apart from the first signal line 802A and the second signal line 802B, whereby variation in potential of the pixel electrodes in the light-transmitting pixel portions caused by variation in potential of the signal lines can be reduced.

Further in the layouts of the pixel in FIG. 7A and FIG. 8, the conductive layer 851 is preferably provided to surround the pixel electrode 805R, the pixel electrode 805G, and the pixel electrode 805B. By providing the conductive layer 851 in the above manner, a light-blocking portion (black matrix) surrounding the pixel electrodes in the light-transmitting pixel portion is not necessarily provided.

In the layouts of the pixels in FIG. 7A and FIG. 8, the capacitor line 803 is provided in parallel to the first signal line 802A and the second signal line 802B. By providing the capacitor line 803 in parallel to the first signal line 802A and the second signal line 802B, the capacitance in an intersection between the wirings can be reduced. Accordingly, noise, delay of a signal, distortion of a signal waveform, or the like can be reduced.

Next, the structure of the cross-sectional view illustrated in FIG. 7B is described. In this embodiment, a method for forming a transistor particularly when a semiconductor layer is formed using an oxide semiconductor is described. The transistor illustrated in FIG. 7B is a transistor including an oxide semiconductor as a semiconductor. An advantage of using an oxide semiconductor is that higher mobility and lower off state current can be obtained in a relatively easy and low-temperature process, as compared to the case using polycrystalline silicon: however, it is needless to say that another semiconductor may be used.

A transistor 410 illustrated in FIG. 7B is a bottom-gate transistor and is also called an inverted staggered transistor. There is no particular limitation on a structure of a transistor which can be applied to a liquid crystal display device disclosed in this specification. For example, a top-gate structure or a bottom-gate structure of a staggered type and a planar type can be used. Further, the transistor may have a single gate structure including one channel formation region, a double gate structure including two channel formation regions, or a triple gate structure including three channel formation regions. Alternatively, the transistor may have a dual gate structure including two gate electrode layers positioned over and below a channel region with a gate insulating layer provided therebetween.

The transistor 410 includes, over a substrate 400 having an insulating surface, a gate electrode layer 401, a gate insulating layer 402, an oxide semiconductor layer 403, a source electrode layer 405*a*, and a drain electrode layer 405*b*. An insulating layer 407 is provided to cover the transistor 410 and be stacked over the oxide semiconductor layer 403. A protective insulating layer 409 is formed over the insulating layer 407.

In this embodiment, as described above, the oxide semiconductor layer 403 is used as a semiconductor layer. As an oxide semiconductor used for the oxide semiconductor layer 403, an oxide of four metal elements such as an In—Sn—Ga—Zn—O-based metal oxide; an oxide of three metal elements such as an In—Ga—Zn—O-based metal oxide, an In—Sn—Zn—O-based metal oxide, an In—Al—Zn—O-based metal oxide, a Sn—Ga—Zn—O-based metal oxide, an Al—Ga—Zn—O-based metal oxide, or a Sn—Al—Zn—O-based metal oxide; an oxide of two metal elements such as an In—Zn—O-based metal oxide, a Sn—Zn—O-based metal oxide, an Al—Zn—O-based metal oxide, a Zn—Mg—O-based metal oxide, a Sn—Mg—O-based metal oxide, or an In—Mg—O-based metal oxide; or an oxide of one metal element such as an In—O-based metal oxide, a Sn—O-based metal oxide, or a Zn—O-based metal oxide can be used. Further, $SiO_2$ may be contained in the above metal oxide. Here, for example, an In—Ga—Zn—O-based metal oxide is an oxide including at least In, Ga, and Zn, and there is no particular limitation on the composition ratio thereof. Further, the In—Ga—Zn—O-based oxide semiconductor may contain an element other than In, Ga, and Zn.

For the oxide semiconductor layer 403, a thin film, represented by the chemical formula, $InMO_3(ZnO)_m$ (m>0) can be used. Here, M represents one or more metal elements selected from Ga, Al, Mn, and Co. For example, M can be Ga, Ga and Al, Ga and Mn, Ga and Co, or the like.

In the transistor 410 including the oxide semiconductor layer 403, the current value in an off state (the off current) can be small. Thus, the time for holding an electric signal such as image data can be extended, and an interval between writings can be extended. Accordingly, the refresh rate can be reduced, which leads to an effect of suppressing power consumption.

Although there is no particular limitation on a substrate used for the substrate 400 having an insulating surface, a glass substrate of barium borosilicate glass, aluminoborosilicate glass, or the like can be used.

In the bottom-gate transistor 410, an insulating layer serving as a base film may be provided between the substrate and the gate electrode layer. The base film has a function of preventing diffusion of an impurity element from the substrate, and can be formed to have a single-layer structure or a stacked structure including any of a silicon nitride layer, a silicon oxide layer, a silicon nitride oxide layer, and a silicon oxynitride layer.

The gate electrode layer 401 can be formed to have a single-layer or stacked-layer structure using a metal material such as molybdenum, titanium, chromium, tantalum, tungsten, aluminum, copper, neodymium, or scandium, or an alloy material which contains any of these materials as its main component.

The gate insulating layer 402 can be formed with a single-layer structure or a stacked structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma CVD method, a sputtering method, or the like. For example, by a plasma CVD method, a silicon nitride layer ($SiN_y$ (y>0)) with a thickness of greater than or equal to 50 nm and less than or equal to 200 nm is formed as a first gate insulating layer, and a silicon oxide layer ($SiO_x$ (x>0)) with a thickness of greater than or equal to 5 nm and less than or equal to 300 nm is formed as a second gate insulating layer over the first gate insulating layer, so that a gate insulating layer with a total thickness of 200 nm is formed.

For a conductive film used for the source electrode layer 405*a* and the drain electrode layer 405*b*, an element selected from Al, Cr, Cu, Ta, Ti, Mo, and W, an alloy containing any of these elements, or an alloy film containing a combination of any of these elements can be used, for example. Alternatively, a structure may be employed in which a refractory metal layer of Ti, Mo, W, or the like is stacked over and/or below a metal layer of Al, Cu, or the like. In addition, heat resistance can be improved by using an Al material to which an element (Si, Nd, Sc, or the like) which prevents generation of a hillock or a whisker in an Al film is added.

The conductive film to be the source electrode layer 405*a* and the drain electrode layer 405*b* (including a wiring layer formed using the same layer as the source and drain electrode layers) may be formed using a conductive metal oxide. As the conductive metal oxide, indium oxide ($In_2O_3$), tin oxide ($SnO_2$), zinc oxide (ZnO), indium oxide-tin oxide alloy ($In_2O_3$—$SnO_2$, which is abbreviated to ITO), indium oxide-zinc oxide alloy ($In_2O_3$—ZnO), or any of these metal oxide materials in which silicon oxide is contained can be used.

As the insulating layer 407, typically, an inorganic insulating film such as a silicon oxide film, a silicon oxynitride film, an aluminum oxide film, or an aluminum oxynitride film can be used.

As the protective insulating layer 409, an inorganic insulating film such as a silicon nitride film, an aluminum nitride film, a silicon nitride oxide film, or an aluminum nitride oxide film can be used.

A planarization insulating film may be formed over the protective insulating layer 409 in order to reduce surface roughness due to the transistor. As the planarization insulating film, an organic material such as polyimide, acrylic, or benzocyclobutene can be used. Other than such organic materials, it is also possible to use a low-dielectric constant material (a low-k material) or the like. The planarization insulating film may be formed by stacking a plurality of insulating films formed from these materials. Note that over the protective insulating layer 409, a necessary component such as a reflective conductive layer or a liquid crystal layer may be formed as appropriate.

This embodiment can be combined with any of the other embodiments as appropriate.

Embodiment 3

In this embodiment, an example of an electronic device including the liquid crystal display device described in the above embodiments will be described.

Figure 9A:
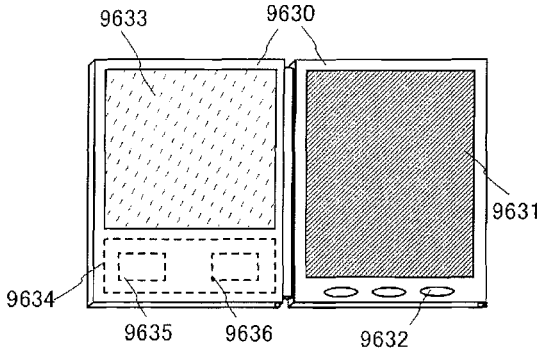
FIGS. 9A and 9B are diagrams for describing an electronic device according to one embodiment of the present invention.

FIG. 9A illustrates an electronic book reader (also referred to as an e-book reader) which include housings 9630, a display portion 9631, operation keys 9632, a solar battery 9633, and a charge and discharge control circuit 9634. The electronic book reader illustrated in FIG. 9A can have various functions such as a function of displaying various kinds of information (e.g., a still image, a moving image, and a text image); a function of displaying a calendar, a date, a time, and the like on the display portion; a function of operating or editing the information displayed on the display portion; and a function of controlling processing by various kinds of software (programs). Note that in FIG. 9A, a structure including a battery 9635 and a DCDC converter (hereinafter abbreviated as a converter 9636) is illustrated as an example of the charge and discharge control circuit 9634.

When a transflective liquid crystal display device is used as the display portion 9631, the e-book reader having the structure illustrated in FIG. 9A is assumed to be used in a comparatively bright environment. In that case, power generation by the solar battery 9633 and charge by the battery 9635 are effectively performed, which is preferable. Note that a structure in which the solar battery 9633 is provided on each of a surface and a rear surface of the housing 9630 is preferable because the battery 9635 can be efficiently charged. When a lithium ion battery is used as the battery 9635, there is an advantage of downsizing or the like.

Figure 9B:
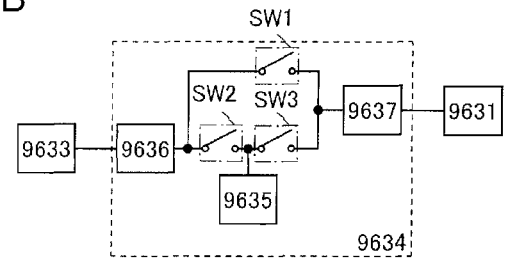

The configuration and operation of the charge and discharge control circuit 9634 illustrated in FIG. 9A are described with reference to a block diagram in FIG. 9B. The solar battery 9633, the battery 9635, the converter 9636, a converter 9637, switches SW1 to SW3, and the display portion 9631 are shown in FIG. 9B, and the charge and discharge control circuit 9634 includes the battery 9635, the converter 9636, the converter 9637, and the switches SW1 to SW3.

First, an example of operation in the case where power is generated by the solar battery 9633 using external light is described. The voltage of power generated by the solar battery is raised or lowered by the converter 9636 so that the power has voltage for charging the battery 9635. Then, when the power from the solar battery 9633 is used for the operation of the display portion 9631, the switch SW1 is turned on and the voltage of the power is raised or lowered by the converter 9637 so as to be voltage needed for the display portion 9631. In addition, when display on the display portion 9631 is not performed, the switch SW1 is turned off and the switch SW2 is turned on, whereby the battery 9635 is charged.

Next, operation in the case where power is not generated by the solar battery 9633 using external light is described. The voltage of power stored in the battery 9635 is raised or lowered by the converter 9637 by turning on the switch SW3. Then, power from the battery 9635 is used for the operation of the display portion 9631.

Note that although the solar battery 9633 is described as an example of a means for charge, the battery 9635 may be charged with another means. In addition, a combination of the solar battery 9633 and another means for charge may be used.

This embodiment can be implemented in appropriate combination with the structures described in the other embodiments.

This application is based on Japanese Patent Application serial no. 2010-019237 filed with Japan Patent Office on Jan. 29, 2010, the entire contents of which are hereby incorporated by reference.

The invention claimed is:

1. A method for driving a liquid crystal display device, the liquid crystal display device comprising:

a first scan line;

a second scan line;

a first signal line;

a second signal line; and a pixel comprising:

a first sub-pixel comprising a first transistor and a first liquid crystal element electrically connected to the first transistor;

a second sub-pixel comprising a second transistor and a second liquid crystal element electrically connected to the second transistor;

a third sub-pixel comprising a third transistor and a third liquid crystal element electrically connected to the third transistor; and a fourth sub-pixel comprising a fourth transistor and a fourth liquid crystal element electrically connected to the fourth transistor, wherein each of the first sub-pixel, the third sub-pixel, and the fourth sub-pixel is a light-transmitting pixel, wherein the second sub-pixel is a reflective pixel, wherein the first scan line is electrically connected to the first transistor and the second transistor, wherein the second scan line is electrically connected to the third transistor and the fourth transistor, wherein the first signal line is electrically connected to the first transistor and the third transistor, and wherein the second signal line is electrically connected to the second transistor and the fourth transistor, the method comprising:

supplying a first scan signal to the first scan line so that the first transistor and the second transistor are turned on, thereby supplying a first image signal and a second image signal to the first liquid crystal element and the second liquid crystal element, respectively, in a moving image display period;

after supplying the first scan signal, supplying a second scan signal to the second scan line so that the third transistor and the fourth transistor are turned on, thereby supplying a third image signal and a fourth image signal to the third liquid crystal element and the fourth liquid crystal element, respectively, in the moving image display period; and supplying a third scan signal and a fourth scan signal simultaneously to the first scan line and the second scan line, respectively, so that the first transistor, the second transistor, the third transistor, and the fourth transistor are turned on, thereby supplying a fifth image signal to the first liquid crystal element and the third liquid crystal element and supplying a sixth image signal to the second liquid crystal element and the fourth liquid crystal element, simultaneously, in a still image display period, wherein the moving image display period is to display a moving image, and wherein the still image display period is to display a still image.

2. The method according to claim 1, wherein in a first display mode, a backlight of the liquid crystal display device does not operate during the still image display period, and wherein in a second display mode, a backlight of the liquid crystal display device operates during the still image display period.

3. The method according to claim 2, wherein a switching from the first display mode to the second display mode is performed in accordance with an illuminance.

4. The method according to claim 1, wherein the second image signal is a signal to display a black image.

5. The method according to claim 1, wherein each of the first image signal, the third image signal, and the fourth image signal is a signal to display a color image.

6. The method according to claim 1, wherein each of the fifth image signal and the sixth image signal is a signal to display a image of black-and-white grayscale.

7. The method according to claim 1, wherein each of the first transistor, the second transistor, the third transistor and the fourth transistor comprises an oxide semiconductor film comprising a channel formation region.

8. The method according to claim 7, wherein a carrier concentration of the oxide semiconductor film is lower than $1\times10^{14}/cm^3$.

9. A method for driving a liquid crystal display device, the liquid crystal display device comprising:

a first scan line;

a second scan line;

a first signal line;

a second signal line; and a pixel comprising:

a first sub-pixel comprising a first transistor and a first liquid crystal element electrically connected to the first transistor;

a second sub-pixel comprising a second transistor and a second liquid crystal element electrically connected to the second transistor;

a third sub-pixel comprising a third transistor and a third liquid crystal element electrically connected to the third transistor; and a fourth sub-pixel comprising a fourth transistor and a fourth liquid crystal element electrically connected to the fourth transistor, wherein each of the first sub-pixel, the third sub-pixel, and the fourth sub-pixel is a light-transmitting pixel, wherein the second sub-pixel is a reflective pixel, wherein the first scan line is electrically connected to the first transistor and the second transistor, wherein the second scan line is electrically connected to the third transistor and the fourth transistor, wherein the first signal line is electrically connected to the first transistor and the third transistor, and wherein the second signal line is electrically connected to the second transistor and the fourth transistor, the method comprising:

supplying a first scan signal to the first scan line so that the first transistor and the second transistor are turned on, in a moving image display period;

after supplying the first scan signal, supplying a second scan signal to the second scan line so that the third transistor and the fourth transistor are turned on, in the moving image display period; and supplying a third scan signal and a fourth scan signal simultaneously to the first scan line and the second scan line, respectively, so that the first transistor, the second transistor, the third transistor, and the fourth transistor are turned on, in a still image display period, wherein the moving image display period is to display a moving image, and wherein the still image display period is to display a still image.

10. The method according to claim 9, wherein in a first display mode, a backlight of the liquid crystal display device does not operate during the still image display period, and wherein in a second display mode, a backlight of the liquid crystal display device operates during the still image display period.

11. The method according to claim 10, wherein a switching from the first display mode to the second display mode is performed in accordance with an illuminance.

12. The method according to claim 9, wherein each of the first transistor, the second transistor, the third transistor and the fourth transistor comprises an oxide semiconductor film comprising a channel formation region.

13. The method according to claim 12, wherein a carrier concentration of the oxide semiconductor film is lower than $1\times10^{14}/cm^3$.

* * * * *